United States Patent [19]

Marlor

[11] 4,061,599

[45] Dec. 6, 1977

[54] COMPOSITION FOR PREPARATION OF A PHOTOCONDUCTOR SURFACE FOR USE IN ELECTROPHOTOGRAPHY

[76] Inventor: Guy Anthony Marlor, 816 Dixon Way, Los Altos, Calif. 94022

[21] Appl. No.: 655,819

[22] Filed: Feb. 6, 1976

[51] Int. Cl.[2] ..... G03G 5/085

[52] U.S. Cl. ..... 252/501; 252/518 G; 427/74; 427/76; 427/330; 96/1.5 R; 96/1.8; 427/376 C; 427/376 D; 427/387; 427/421

[58] Field of Search ..... 427/76, 74, 75, 376 C, 427/376 D, 387, 421, 330; 252/501, 518.1; 96/1.5, 1.8

[56] References Cited

U.S. PATENT DOCUMENTS

| | | | |
|---|---|---|---|
| 1,875,721 | 9/1932 | Frost | 427/376 D |
| 1,938,691 | 12/1933 | Dougherty | 427/376 D |
| 2,930,999 | 3/1960 | Van Santen et al. | 252/501 |
| 2,937,353 | 5/1960 | Wasserman | 252/501 X |
| 2,965,867 | 12/1960 | Greig | 427/76 X |
| 3,151,982 | 10/1964 | Corrsin | 252/501 X |

*Primary Examiner*—Ralph S. Kendall
*Attorney, Agent, or Firm*—Warren M. Becker

[57] ABSTRACT

A surface is prepared for use in electrophotography by spraying an enamel slip comprising a non-aqueous carrier vehicle, a photoconductive powder and glass enamel frit thereon.

22 Claims, No Drawings

COMPOSITION FOR PREPARATION OF A PHOTOCONDUCTOR SURFACE FOR USE IN ELECTROPHOTOGRAPHY

BACKGROUND AND SUMMARY

Various electrophotographic processes have been developed and have achieved wide acceptance. Generally, these processes utilize a photoconductive surface, typically on a drum, to transfer the image of the subject matter to the copy medium. The photoconductive surface is employed to convert the optical image to an electrical image. See, for example, "A Comparison of Some Electrophotographic Processes Based on Photoconductor-Insulator Layer Combinations," in the Volume 18, No. 3, May-June issue of Photographic Science and Engineering.

A great deal of effort has been directed towards producing photoconductive surfaces which are sensitive, durable and highly uniform in their response to the optical image. For example, see U.S. Pat. No. 3,151,982 issued on Oct. 6, 1964 to Lester Corrsin, and entitled XEROGRAPHIC PLATE and also U.S. Pat. No. 3,837,906 issued on Sept. 24, 1974 to Robert N. Jones and entitled METHOD OF MAKING A XEROGRAPHIC BINDER LAYER AND LAYER SO PREPARED.

Some attempts to increase the uniformity of the application of the photoconductive material to the surface of the drum have been directed towards the use of an enamel slip. See, for example, the above-mentioned patent to Corrsin. Basically, these techniques tried in the prior art have emulated techniques used in the enamelling industry. These prior art enamel slips were water-based and employed relatively low photoconductor concentrations, e.g., 4% to 20% of the weight of the solids. These enamel slips exhibited several disadvantages when they were used to prepare a photoconductive surface. One of these disadvantages was the requirement of critical drying and firing schedules to avoid cracking of the surface during the curing process. Another disadvantage of prior art enamel slips was the deleterious effect the water contained therein had on the photoconductive material. Also, using these water-based compounds, it was not possible to produce an enamel slip with the high pigment concentrations desired for electrophotographic uses, e.g., 50% by weight of the solids. Prior art attempts to produce enamel slips with such high concentrations of photoconductive material resulted in severe cracking and other poor surface characteristics. For example, see the above-mentioned U.S. Pat. No. 3,151,982 wherein it is stated that in photoconductive surfaces prepared using an aqueous base enamel slip wherein the pigment concentration exceeded 15%, the result was a rough surface with poor adhesion and poorly suited for electrophotography. There have been some suggestions in the literture that this can be overcome by adding elements such as waterglass, i.e. sodium silicate, to hold the coating together, but this would have detrimental effects on the performance of the photoconductor material due to the conductivity of the sodium silicate and by contamination from Group I metals. Similarly, miscellaneous chemical additives generally used in enamel either as adhesive or suspension agents contain Group I metals such as sodium and potassium which are electrically active and interfere with the operation of the photoconductor particles in the coating. Hence, there were no prior art solutions to making satisfactory photoconductive coatings by spraying an enamel slip. Other prior art techniques used to prepare photoconductive surfaces involved the reverse roller coating of discontinuous surfaces, but these techniques resulted in unstable and fragile coatings.

In accordance with the preferred embodiment of the present invention, a photoconductive surface coating suitable for use with the various methods of electrophotography is provided by spraying an enamel slip on a surface to provide a continuous film coating of photoconductive material. The enamel slip comprises a nonaqueous carrier vehicle, a photoconductive powder, a glass enamel frit, and miscellaneous additives. The technique is particularly useful in making films which are resistant to moisture under conditions which might tend to abrade the surface of the coatings. The coatings produced eliminate any seam characteristic of some prior art techniques and provide highly stable, photoconductive surfaces for repetitive use in electrophotography. The spray techniques described are also much simpler than other techniques under development such as the dipping of substrates.

DESCRIPTION OF THE PREFERRED EMBODIMENT

A distinctive feature of the prior art techniques to provide photoconductive coatings through a spray operation was the use of water-based solvents and solvents that are miscible with water. Because of the high concentrations of pigment, i.e., photoconductive material, required for use with the various processes of electrophotography, previous efforts to produce an enamel slip for electrophotography have been unacceptable. However, in accordance with the preferred embodiment of the present invention, an enamel slip is provided which comprises a multiple organic solvent base, which may be applied to the surface by a spraying operation, and which results in a highly uniform coating with superior resistance to cracking, and other surface anomalies.

The basic formulae whereby very high concentrations of pigments can be suspended and sprayed into uniform coatings from an enamel slip is based on a nonaqueous multiple-solvent suspension system, utilized to allow the generation of coatings without cracking and to allow the use of electrically inactive suspension agents. Solvent systems consisting of two or more components are essential for good control of the coatings. This is especially important in preparing the photoconductive coatings because the coatings must be applied in a single pass of a spray gun for best results. Prior art techniques using multiple application of a spray material have been unsuccessful in producing acceptable photoconductive surfaces, the coatings showing poor electronic properties.

A carrier vehicle has been formulated using butyl acetate and butyl carbitol interchangeably. This carrier vehicle can be used as a single component but leads to difficulty in correct atomization and viscosity control in the face of variations in room temperature and minor variations in the viscosity, and the procedures used in mixing different batches of the enamel slip. Isopropyl alcohol is added to the carrier vehicle as an aid to volatilization and atomization, the proportion being adjusted to allow for flow-out and the rapid setting-up of the coating. The addition of isopropyl alcohol allows relatively low-pressure atomization of the paint, with subsequent tolerable bounce-back and associated low impact speed of the spray. Ethyl alcohol and methyl alcohol have also been used with success. Amyl alcohol has been used as a third component, giving improved finishes. A tendency for coatings to crack due to too high a solvent concentration has to be avoided, thus the solvents should be held close to 30% of the mass of the paint with some minor variations depending upon the solvent boiling points and the spray conditions.

Several different elements must be controlled to provide the highest quality photoconductive coatings using spray techniques. A very fine stable photoconductor powder must be obtained. Preferably, the material will remain unchanged in high humidities and under the influence of corona ions, such as those experienced in an office copying machine. The material must be able to be milled and sprayed without affecting its photoconductor properties.

Also, the paint-control techniques of the present invention must be used to allow suspension of the pigment, i.e., the photoconductive powder in a stable suspension in an organic vehicle. These paint-control techniques allow for the effective spraying of the photoconductor enamel without contamination from clays and other electrolytes which are normally used in water-based enamels. Prior art techniques using water-based paints or slurries have used suspension agents that are harmful to the electronic properties of photoconductor materials. In contrast to prior art techniques, fumed silica, available under the tradename "Cab-O-Sil," and lecithin are used as suspension agents without a resin-solvent base and with a very high content, relative to prior art slips, of photoconductor material. Paint viscosity is very important and good control of the enamel ingredients is critical for forming a smooth final coating suitable for use with electrophotographic techniques.

Additional solvents may be added to the vehicle carrier but a two-solvent system is satisfactory for room-temperature spraying with conventional equipment. Better results are obtained using a three-component organic solvent, each component having a different boiling point. The lowest boiling-point component is selected to enhance the atomization of the paint while spraying the slip. This is done by lowering the viscosity of the paint, but during atomization this first component boils off rapidly, and limits the sag when sprayed on vertical or curved surfaces. A second and higher boiling-point component is selected to allow secondary flow-out of the material once it is on the surface that is being painted. A third and highest boiling-point component is selected as the basic suspension element. This third component should be relatively high boiling point, high molecular weight material such as butyl carbitol or butyl acetate.

Specific characteristics of the glass used in the enameel slip are that: it should be electrically insulating; it should be chemically stable, especially with respect to photoconductor pigments; and it should have a minimum of electrically active materials. For example, sodium, potassium, or zinc in certain forms will ruin the characteristics of the photoconductor material. The glass used should have a relatively low firing temperature, for example, 600° C or less. Generally, it will comprise from 30 to 70% by weight of the solids of the enamel slip.

The glass component is sometimes referred to as glass enamel frit or simply enamel frit although it is actually a powdered glass with the characteristics referred to above. Examples of a suitable glass are Corning Code 7570 glass for use on steel, and an example of the glass for use on an aluminum substrate is AL 46 available from Ferro Corporation. The Corning 7570 glass is a glass which is stable for a steel substrate, but it also is satisfactory for putting on glass and materials with an expansion coefficient of 150 parts per million per degree centigrade or less. The glass for use on an aluminum substrate may be used on several types of aluminum. It has an expansion of approximately 230 parts per million per degree centigrade.

A suitable glass frit can be prepared by milling of commercially-available glass, minus 325 mesh, provided the photoconductor material is both small in particle-size and is stable. Coatings can also be made with glass classified to be less than say three microns. A Donaldson classifier has been used to provide a yield of such material of 4%. Paint made with such material requires a similar level of fumed silica and lecithin. Coatings made with glass having a significant percentage of glass particles over five microns in size show small specks of high charge in some systems, whereas no such specks are visible using other electrophotographic techniques. However, drums made with the glass classified to be less than three microns are not known to show specks using either cascade, powder cloud, liquid or magnetic brush toning.

Although glass frit of three microns or less particle size is satisfactory, improved surfaces can be expected when smaller particles are used. These particles may be obtained using conventional or air jet milling. A classifier will not be needed to separate the particles if air jet milling is followed by a wet milling.

A major component is the photoconductor powder. This is selected or formulated for the desired electrical characteristics such that it is operable in the desired process, e.g., xerographic or canon N.P. Such powders can be prepared in the laboratory or bought as commercial powders from the SIMAC Company, RCA, and the Ferro Corporation, for example. Such materials are described in Pat. No. 3,151,982 in the bottom portion of column 4, line 60 et seq., in particular.

The photoconductor material should be a small particle size stable material which is not sensitive to moisture. Several materials such as combinations of cadmium and zinc with selenium, tellurium, oxygen, or sulphur can be used. The preferred material is cadmium sulfide with a few percent, e.g., 1 - 8%, of cadmium selenide. The concentration of the photoconductor powder or "pigment" varies from 30 to 70% by weight of the solids, depending on the application. Previously, prior art attempts to use an enamel slip or a paint resin system have been limited to approximately 4 - 15% pigment content of the total solids content.

Fumed silica and lecithin are used as suspension agents and to control the viscosity. Note that these agents would not be effective with a water-based solvent system. Some prior art techniques in the paint industry have used these agents in formulae which are based on high proportions of resin. However, the formulae of the present invention specifically excludes the use of such resins.

The fumed silica is made by spraying silicon tetrachloride in a clean environment to get the very small particle and inert material. Fumed silica has a characteristic of being very small and it is sometimes referred to as a network former because it is believed that the chemical bonds of the silica tend to form a stable suspension. Other network formers, such as the clays, would be usable provided they were chemically clean enough not to affect the photoconductor. An acceptable substitute for the fumed silica is aluminum oxide in a finely powdered form.

The material referred to as Cab-O-Sil is a tradename for a product which is 2/10ths micron fumed silica. It turns the mixture into a suspension with thixotropic properties. This material has been commonly used in paints and is used in our formulae to replace the clays normally employed in conventional enamels since, as described above, these clays are detrimental to the photoconductor properties of the finished product. The silica operates to control the viscosity and suspension properties of the slip.

Lecithin is used as an emulsifier, and assists in controlling the paint viscosity. It is a primary agent in avoiding runs and blobs during the enamel-drying. Without the addition of lecithin, difficulty is experienced in drying the coatings to a smooth finish.

Colloidon, an additive particularly useful with slips having very small particles, is a commercial mixture of nitrocellulose in ether and alcohol and has been found beneficial in controlling the shrinkage, on drying, of such finely milled enamels. It allows more rapid diffusion of solvents through the paint and reduces the tendency to crack.

A basic formulation for an acceptable enamel slip for use in making photoconductive surfaces is as follows:

A base is prepared of 210 grams 7570 glass frit, 150 ccs butyl carbitol, and 100 ccs isopropyl alcohol. Note the formula uses a two solvent base. Butyl Carbitol is a tradename of the duPont Company for 2-butoxy ethoxy ethanol. This base is milled for 60 hours in 6-inch diameter mills with one-half and one-quarter inch porcelain balls at approximately 110 revolutions per minute. The net effect of this operation is to reduce the minus 325 mesh glass to one micron or less as determined by optical microscopy. Sensitized cadmium sulfide or cadmium sulfide/selenide is added together with Cab-O-Sil and lecithin. Best results have been obtained when these are added in the ratios 210 grams, 5.6 grams, and 1.7 ccs, respectively. If colloidon is used, 36 ccs would be added to this mixture. This final mixture is then milled for three hours. The density should then be approximately 2 grams/cc and the viscosity 40-60 centipoise. This density should be adhered to despite variations in ingredients which comprise a particular enamel slip.

A good enamel slip comprising a three-solvent vehicle carrier may be made as follows:

butyl acetate — 160 ccs
isopropyl alcohol — 70 ccs
amyl acetate — 60 ccs
photoconductor powder — 240 grams
glass frit (10 microns or less) — 240 grams The above ingredients are put together in a ball mill and milled with two specific additives: approximately 5.6 grams of fumed silica having a particle size of .2 micron, a suitable product being available under the tradename Cab-O-Sil; and approximately 1.8 ccs of the emulsifier called lecithin. The fumed silica acts as a suspension agent and gives the material thixotropic properties such that the components of the slip do not separate under spraying conditions, while the lecithin emulsifies the material. The lecithin or other emulsifier selected has or should have the characteristic of dissolving in both oil and water based materials. This has been found to aid in the prevention of blemishes in the finished coating. It is also a very significant factor in determining the slip viscosity. The fumed silica comprises from ¼ to 4% by weight of the solids, with a preferred concentration of 2%. The lecithin emulsifier comprises from 1/10 to 4% of total volume, with a preferred concentration of ½%.

A more general formula and method for preparing enamel slips for use in electrophotography is described below.

A mixture of 20–80% photoconductive powder and 80–20% glass frit is prepared. The solvent is then added until a density of approximately 2 grams/cc is obtained. The solvent may be prepared as described above using at least two solvents, preferably three, or a commercial solvent, e.g., Glidden vinyl texture reducer 6010–0390 which comprises 5% aliphatics, 10% esters and ethers, 85% butyl carbitol, may be used. After the proper density is reached selected additives are added. Lecithin or other emulsifier is added between 1/10–4% of the total volume to achieve the desired viscosity. A suspension additive, e.g., fumed silica, is then added between ¼–4% of the weight of the slip. Too much lecithin or other emulsifier is characterized by a very viscous mix while too low a percentage is characterized by incomplete mixing of the enamel slip. Too much fumed silica results in severe surface tension and cracking while too low a concentration will result in an inadequate suspension of the ingredients.

Preparation of the base surface is also critical. For example, using a steel base, the metal should be prepared by the following steps: Heat at 700° C for two hours or more to remove carbon. The substrate is cleaned and then coated with one-thousandth of an inch of bright nickel and then 20 to 100 millionths of an inch of chronium. Preferably, the nickel is placed over a copper strike. The next step is to oxidize the chromium at 560° C for one hour or more to provide the proper electrical contact and adhesion of the finished enamel to the steel substrate. The enamel slip is then applied and dried below 80° C, preferably at 65° C. It is then fired at approximately 511° C for one hour. With these finely divided enamel slips it has been found necessary to heat and cool the dried coatings at rates substantially less than used in prior enamelling practice. E.g., no more than 100° C temperature change per hour.

An added step is the spraying of a 2-micron coating of silicone oil on the enamel coating and baking it on the surface. This treatment reduces the surface conductivity of the enamel at high humidity conditions and eliminates leakage and loss of the electrical image at humidities up to 75%. An effective solution for spraying comprises a silicone oil, e.g., Dow Corning DC 200 silicon oil, at approximately a 2% concentration in carbon tetrachloride. This solution is sprayed at approximately a 1-2 micron thickness, dried at 100° C for half an hour, and then baked at 300° C for half an hour.

Using spray techniques and formulae in accordance with the present invention, continuous stable coatings of photoconductive material not useable with prior art techniques, e.g., cadmium sulfide, may now be provided. Hence, photoconductive coatings may be prepared which are superior to the prior art techniques of vacuum evaporated selenium used in the xerographic process. Similarly, superior coatings are provided for use with other electrophotographic techniques. These coatings eliminate the seam characteristic of prior art techniques.

I claim:

1. An enamel slip devoid of natural and synthetic resins for use in the preparation of a photoconductive surface wherein the slip is sprayed upon the surface, said enamel slip comprising a mixture of:

solids comprising a photoconductive powder and a glass powder, both powders having an average particle size below ten microns;

a carrier vehicle comprising a plurality of organic solvents, at least one of said plurality of organic solvents being selected to enhance atomization of the slip during spraying and at least one of said plurality of organic solvents being selected as a physical suspension element for the solids; and particulate solid means for suspending the solids in the carrier vehicle by physical dispersion, the particulate solid means for suspending being substantially chemically and electrically nonreactive with the solids.

2. The enamel slip as in claim 1 wherein the photoconductive powder comprises cadmium sulfide.

3. The enamel slip as in claim 2 wherein the photoconductive powder includes between 1 and 8% cadmium selenide.

4. The enamel slip as in claim 1 wherein said glass powder comprises glass particles having an average size of three microns or less.

5. The enamel slip as in claim 4 wherein the glass powder has a firing temperature of 600° C or less.

6. The enamel slip as in claim 5 wherein the glass powder comprises glass particles having a coefficient of expansion approximately equal to that of said steel substrate.

7. The enamel slip as in claim 6 wherein the glass powder comprises between 30 and 70% by weight of said solids.

8. The enamel slip as in claim 7 wherein said photoconductor powder comprises between 70 and 30% by weight of said solids.

9. The enamel slip as in claim 1 wherein the particulate solid means comprise fumed silica.

10. The enamel slip as in claim 9 comprising lecithin.

11. The enamel slip as in claim 10 wherein said lecithin comprises between 1/10% and 4% of the total volume of the slip.

12. The enamel slip as in claim 9 wherein said fumed silica comprises between ¼% and 4% of the total weight of said solids.

13. The enamel slip as in claim 1 wherein the particulate solid means comprise powdered aluminum oxide.

14. The enamel slip as in claim 1 further comprising an additive for use as a network former.

15. The enamel slip as in claim 14 wherein said additive for use as a network former comprises colloidon.

16. An enamel slip as in claim 1 wherein the carrier vehicle comprises at least one organic solvent selected from the group of solvents consisting of butyl acetate and butyl carbitol.

17. An enamel slip as in claim 1 wherein the carrier vehicle comprises at least one organic solvent selected from the group consisting of isopropyl alcohol, ethyl alcohol and methyl alcohol.

18. An enamel slip as in claim 1 wherein the carrier vehicle comprises amyl alcohol.

19. An enamel slip devoid of natural and synthetic resins for use in preparation of a photoconductive coating on a surface comprising:

a carrier vehicle comprising a plurality of organic solvents, at least one solvent selected from the group of solvents consisting of butyl acetate and butyl carbitol and at least one solvent selected from the group consisting of isopropyl alcohol, ethyl alcohol and methyl alcohol;

solids comprising a photoconductor powder and a glass powder, both powders having an average particle size below ten microns in diameter; and means for suspending the solids in the carrier vehicle by physical dispersion, the means for suspending being chemically and electrically nonreactive with the solids.

20. An enamel slip as in claim 19 wherein means for suspending comprise fumed silica.

21. An enamel slip as in claim 20 comprising lecithin.

22. An enamel slip as in claim 20 comprising amyl alcohol.

* * * * *